United States Patent [19]

Kumar et al.

[11] Patent Number: 4,561,892

[45] Date of Patent: Dec. 31, 1985

[54] SILICON-RICH ALLOY COATINGS

[75] Inventors: Prabhat Kumar; Vidhu Anand, both of Kokomo, Ind.

[73] Assignee: Cabot Corporation, Boston, Mass.

[21] Appl. No.: 617,010

[22] Filed: Jun. 5, 1984

[51] Int. Cl.[4] ..... C23C 7/00; C22C 19/03; C22C 19/07

[52] U.S. Cl. ..... 75/251; 420/441; 420/457; 420/435

[58] Field of Search ..... 75/251, 123 L, 0.5 BA, 75/0.5 AA; 420/441, 457, 435; 148/6.3

[56] References Cited

U.S. PATENT DOCUMENTS 1,753,904 4/1930 Plummer ..... 420/457
1,890,595 12/1932 Valenta ..... 75/123 L
2,222,472 11/1940 Bishop ..... 420/457
2,222,473 11/1940 Bishop ..... 420/457
3,015,880 1/1962 Stephenson ..... 420/441
3,839,014 10/1974 Cziska et al. ..... 75/123 L

*Primary Examiner*—Wayland Stallard
*Attorney, Agent, or Firm*—Joseph J. Phillips; Jack Schuman

[57] ABSTRACT

Disclosed is a coated substrate article coated with an alloy powder containing, in weight percent, 7 to 19 silicon, up to 5 copper balance nickel, cobalt and/or iron plus impurities. The articles may be coated by a variety of spray coating processes; however, plasma spray coating is preferred. The coated article is especially suited for use in severe conditions of wet corrosion.

10 Claims, No Drawings

SILICON-RICH ALLOY COATINGS

This invention relates principally to silicon rich alloys in the form of coatings on substrate articles of manufacture. The alloys may be iron, cobalt or, preferrably, nickel base.

PRIOR ART REVIEW

Known in the art are alloys containing principally nickel and silicon or cobalt and silicon especially suited for use in corrosive conditions. U.S. Pat. Nos. 1,350,359; 1,514,064 and 1,680,058 disclose generally nickel base with high contents of silicon. Alloys of this class are produced as castings because they are not ductile and therefore very difficult to be produced as wrought materials. The series of U.S. Pat. Nos. 2,222,471; 2,222,472; 2,222,473 also disclose similar alloys with various additions (Al, Sb, Cu) to modify the corrosion resistance of the alloy.

Iron base alloys with high levels of silicon are disclosed in U.S. Pat. Nos. 2,422,948, 2,948,605, 2,992,917 and 3,206,304. U.S. Pat. No. 2,992,917 discloses corrosion resistant, hot-working Fe NiSi alloys. U.S. Pat. No. 1,513,806 discloses cobalt alloys for use in wet corrosive conditions such as sulfuric acid liquors containing chlorides and nitrates. U.S. Pat. No. 1,753,904 discloses a nickel base alloy containing silicon, copper and aluminum also for use in wet corrosive conditions. U.S. Patent No. 3,519,418 discloses high silicon nickel base alloys containing titanium and aluminum in the form of powder for use in brazing Operations. U.S. Pat. No. 2,868 667 relates to high silicon nickel base alloys containing high chromium, carbon and boron additions for use as spraying powders to form coatings. The coatings are porous to retain lubricants.

U.S. Pat. Nos. 2,875,043 and 2,936,229 disclosed somewhat similar alloys also with a high boron content, known as "self-fluxing alloys." These are hard facing alloys for use in spray welding wherein the sprayed coating is fused. U.S. Pat. No. 2,864,696 also discloses boron containing alloys that are first spray coated then fused for use as a composite product.

These patents disclose silicon containing wear and corrosion resistant alloys and methods to spray weld coatings made from alloys of said powders. However, none of these patents pertains to porous coatings which are corrosion resistant to aqueous, especially $H_2SO_4$ containing, environment corrosion resistance is imparted by sealing off porosity either by fusion or by resin impregnation.

In the present art, spray coating, this class of alloys results in coatings that have various degrees of uncontrolled porosity. There are a number of solutions to the problem. Among them, a fusion step as indicated in tne described patents; impregnation of the coating with sealants such as resins and plastics; coalescence of boron-rich metal powder by "torching" is described in U.S. Pat. No. 2,864,696.

These solutions are effective for the most part but are expensive because of the extra fusing step. The fusion step is very critical. The temperature together with fusion processing time must be controlled to avoid incomplete fusion if too low and product distortion and compositional damage if too high.

Impregnation of the porous coatings with sealants (resins and the like) is also an expensive extra step. Control of the depth of sealant penetration may be difficult, thus, resulting in imperfect products. Furthermore, the sealant is subject to thermal and/or chemical deterioration while being processed or in use in the event of overheating or in harmful exposures.

These critical limitations have prevented a broader practice of spray coating substrate articles to provide corrosion resistance.

OBJECTS OF THIS INVENTION

It is a principal object of this invention to provide metal powders especially suited for us as coatings. It is another principal object of this invention to provide methods to coat substrate articles.

SUMMARY OF THIS INVENTION

These and other objects are provided by an alloy system containing 76 to 93% at least one element of the group nickel, iron, and cobalt; 7 to 19% silicon and up to 5% copper, in the form of a metal powder suitable for application as a coating on articles subject to corrosion environments.

The alloy may contain other modifying elements or impurities as normally found in alloys of this class. At times, these other elements may be beneficial, or innocuous, or harmful. Some are adventitious from raw material sources or even deliberately added to provide additional beneficial characteristics, as known in the art. In view of this, aluminum, titanium, molybdenum, manganese may be present up to about 5%. Boron, sulfur, and phosphorus are impurities up to 0.5% and must not be added. The metal powder, as deposited on a substrate, must be porous of less than about 99% dense. During service in $H_2SO_4$ containing solutions, at the surface of the metal particles, the silicon becomes silica. This transformation results in an expansion of particle size. The expansion thereby provides two very favorable results (1) the coating surface becomes more fully dense and (2) the surface becomes essentially silica. Thus, the coated article is essentially non-porous and corrosion resistant.

Although the exact mechanism is not completely understood, it is believed that the oxidation of silicon and the attendant expansion, mentioned above, provide the desired characteristics to the porous coating as deposited.

Hardfacing, by fusion of coating metal on a substrate does not provide the full benefits of this invention. The fusion step may cause distortion to the substrate article. Furthermore, the coating thickness is difficult to control and/or must be machined to provide dimensional requirements on the finished part. At times, hardfacing results in cracked deposit.

TEST RESULTS

A study was made comparing the product and process of this invention to available products in wrought form now in the art.

Alloys now available in the art include Alloys C-276 and G-3 (Cr. Mo containing nickel base) Alloy B-2 (Mo Ni alloy), had much higher corrosion rate than the product of this invention in acids, such as sulfuric acid.

It is known in the art nickel base alloy, as mentioned above, are also available in the form of powders for spraying. However, the as-sprayed coating is not as corrosion resistant as the wrought form, because of the porosity. Steps to overcome this deficiency include resin impregnation.

In a series of tests, alloy powders were made via water and nitrogen atomization. The basic alloy as melted had the following composition, in weight percent: carbon 0.004, cobalt 0.13, chromium 0.09, copper 2.60, iron 0.10, manganese 1.0, silicon 9.97 and the balance nickel plus impurities. While the composition of the powders made by the two process was similar, a significant difference was observed in the oxygen content of the two powders. Typical oxygen level in water atomized powder was 0.05 weight percent versus 0.015–0.025 wt % in nitrogen atomized powder. Thus, water atomization is preferred.

Plasma sprayed deposits of coating thickness varying from 0.015 inches up to 0.04 inches were made with the two powder grades. Corrosion testing (one-sided) was done in 60%, 77% and 99% sulfuric acid concentration at 140° C. Corrosion rates were measured as average in mils per year (mpy) of a 10 day test. 60% $H_2SO_4$ resulted in highest corrosion rates. At this acid concentration, thinner coatings (0.015–0.02 inch) with water atomized powder had corrosion rates from 115–225 mpy. A 0.04 inch coating (water atomized powder) showed 41 mpy attack. Similar rates were observed in a 0.04 in. coating (water atomized) using resin fusion. However, corrosion rates of 0.04 in. coatings of gas atomized powder increased to 54 mpy and 117 mpy for as sprayed and sprayed and resin fused cases respectively. Superior corrosion rates with water atomized powder coatings are believed to be due to higher oxygen levels which results in greater-degree of oxidation and silica film formation. Thus, water atomization is preferred.

Corrosion rates at 77% $H_2SO_4$ and 99% $H_2SO_4$ in all cases were less than 10–12 mpy, with lowest rates at 99% $H2SO_4$. By comparison the corrosion rate of a cast sample at 60%, 77% and 99% $H_2SO_4$ concentrations was 75 mpy, 6 mpy and 4 mpy respectively. In addition, no advantage to resin fusion (for closing porosity) was observed in terms of corrosion performance. Similar trends were observed when electrochemical testing (anodic polarization) was performed in 60% and 77% $H_2SO_4$ concentrations at room temperature.

There appears to be no serious limitation regarding the substrate material; it may be a superalloy, an iron base alloy, a steel or a non-ferrous alloy.

The coating may be applied to the substrate by a variety of processes, for example, electric arc such as plasma spraying or flame spraying such as JET KOTE process and combustable gas-oxygen systems.

Metal powder may be produced by other methods. For example, various powders may be blended to obtain the spray powder of this invention. For example, powder of nominal Ni-9% Si-3% Cu composition was produced as follows: small (2–3 micrometers) particles of Ni38% Si alloy were blended with copper (particle size: less than 44 microns). The blend was heated for two hours in hydrogen at 1350° F. The resulting cake was crushed into fine (smaller than 75 microns) particles.

These particles were used to coat the surface of mild steel cylinders. Metco 7-M Plama gun was used. The coating thickness was 0.025. It was tested in various concentrations of sulfuric acid by immersing the sample. Duplicate tests were conducted. Test results are given below:

| Media | Temp | Corrosion Rate in Ten Days (in mpy) |
|---|---|---|
| 60% $H_2SO_4$ | Boil | 377 |
| 77% $H_2SO_4$ | 140° C. | 19 |
| 99% $H_2SO_4$ | 140° C. | 12 |

What is claimed is:

1. A metal alloy powder, substantially less than 75 microns in particle size, for use in spray coating processes, said alloy consisting essentially of, in weight percent, 7 to 19 silicon, up to 5 copper, 76 to 93 total nickel and cobalt, plus impurities.

2. The metal powder of claim 1 produced by one process selected from the group gas atomization and water atomization processes.

3. The metal powder of claim 1 produced by blending alloyed or unalloyed powders to obtain desired composition.

4. The metal powder of claim 1 deposited on a substrate article by a method selected from the group electric arc and flame spraying.

5. The method of coating a substrate article including the steps, producing the metal powder of claim 1, spray coating said article with said powder, characterized by heat treating the coated article to promote oxidation of the resultant deposit.

6. An article of manufacture comprising a substrate article coated by a method selected from the group electric arc and flame spraying with the metal powder of claim 1.

7. The article of claim 6 wherein the coating method is plasma spraying.

8. The article of claim 6, wherein the coating method is combustible gas-oxygen flame spraying system.

9. A metal alloy powder, substantially less than 75 microns in particle size, for use in spray coating processes, said alloy consisting essentially of, in weight percent, 7 to 19 silicon, up to 5 copper, 76 to 93 nickel, plus impurities.

10. A metal alloy powder, substantially less than 75 microns in particle size, for use in spray coating processes, said alloy consisting essentially of, in weight percent, 7 to 19 silicon, up to 5 copper, 76 to 93 cobalt, plus impurities.

* * * * *

UNITED STATES PATENT AND TRADEMARK OFFICE

CERTIFICATE OF CORRECTION

PATENT NO. : 4,561,892

DATED : Dec.31 1985

INVENTOR(S) : Prabhat Kumar; Vidhu Anand

It is certified that error appears in the above-identified patent and that said Letters Patent is hereby corrected as shown below:

Inventors: should read --Prabhat Kumar; Vidhu Anand; Aziz I. Asphahani; Kokomo and Steven Matthews; Greentown Ind, PRIOR ART REVIEW, column 1 line 55 "tne" should read --the--.

OBJECTS OF THIS INVENTION, column 2 line 11 "us" should read --use--.

Signed and Sealed this

*Seventeenth* Day of *June 1986*

[SEAL]

*Attest:*

DONALD J. QUIGG

*Attesting Officer*

*Commissioner of Patents and Trademarks*